United States Patent [19]

Carracoy

[11] Patent Number: 4,540,007

[45] Date of Patent: Sep. 10, 1985

[54] COSMETIC APPLICATOR AND CONTAINER ASSEMBLY FOR ASEPTIC APPLICATION OF COSMETICS

[75] Inventor: Claudio Carracoy, Rome, Italy

[73] Assignee: Oftalysine S.r.l., Rome, Italy

[21] Appl. No.: 667,071

[22] Filed: Nov. 1, 1984

Related U.S. Application Data

[63] Continuation of Ser. No. 361,596, Mar. 25, 1982, abandoned.

[30] Foreign Application Priority Data

Oct. 28, 1981 [IT] Italy ..... 36103/81[U]

[51] Int. Cl.[3] ..... A45D 40/30

[52] U.S. Cl. ..... 132/88.5; 401/132

[58] Field of Search ..... 132/88.5, 88.7, 73; 401/132

[56] References Cited

U.S. PATENT DOCUMENTS

| | | | |
|---|---|---|---|
| 756,806 | 4/1904 | Stolte | 132/89 |
| 3,033,213 | 5/1962 | Joss et al. | 132/88.7 |
| 3,885,578 | 5/1975 | Hicks | 132/88.5 |
| 4,218,155 | 8/1980 | Weidner | 401/132 |

*Primary Examiner*—Gregory E. McNeill

[57] ABSTRACT

A unidose mascara dispenser for aseptically dispensing and applying make-up for eyelashes comprises; in combination, a plurality of sealed containers, each container having a spreading or application stick, and an extracting-gripping unit provided with means for engaging and removably joining the spreading stick, which is used for removing the spreading stick and applying the make-up.

2 Claims, 2 Drawing Figures

COSMETIC APPLICATOR AND CONTAINER ASSEMBLY FOR ASEPTIC APPLICATION OF COSMETICS

Figure 1:
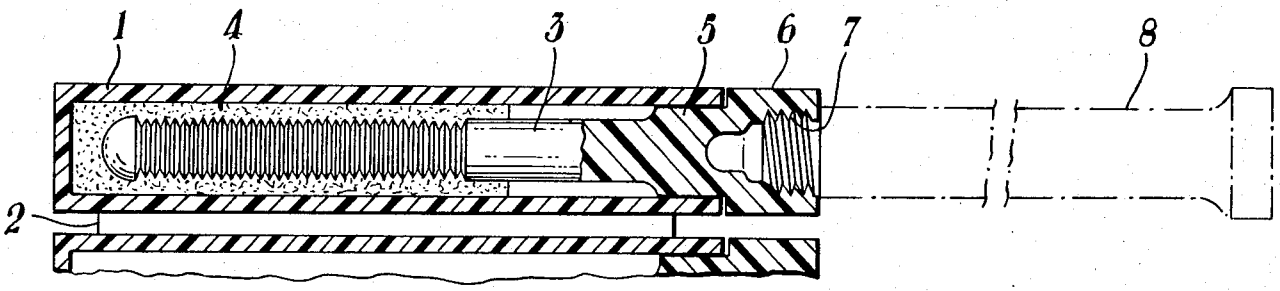

This application is a continuation of application Ser. No. 361,596, filed on Mar. 25, 1982 now abandoned.

This invention relates to a unidose mascara dispenser for applying make-up for eyelashes.

In the state of the art, the application of cosmetic products on eyelashes (mascara) can be made in two different ways, namely:

(1) Drawing the product in semisolid or creamy state, by means of a small wet brush, and applying the product on eyelashes;

(2) Extraction of a small brush already covered by a layer of product from a special container (mascaramatic) and subsequent application of the cosmetic product on eyelashes. After the application, the brush has to be reinserted into the container.

The use of both of the above techniques causes a microbiologic pollution of the mascara itself, due to the contact of brush with the mascara in presence of germs that originate from external sources, (e.g. water, dust) and from the ciliary apparatus of the user, or of various users, as it happens in beauty parlors.

The microbiologic pollution of the mascara is usually controlled by means of compositions which reduce or prevent the growth of bacteria.

The products are responsible for some inconveniences:

They are often ineffective towards some kinds of germs;

In the course of time they show a tendency to lose their effectiveness;

They promote the development of resistant strains; and

In many instances they cause an allergic reaction.

Bearing in mind the utmost delicacy of the application site (ciliary apparatus, i.e., eyelashes and the contiguity of the application site with the internal mucous membranes of the anterior part of the eye (conjunctiva, cornea, and so on), the application of biologically polluted mascara may cause either the development of ocular infections due to pathogenic microorganisms, or the onset of local allergies by bacterial endotoxins.

In medical literature, particularly in the last ten years, there have been disclosed ocular diseases due to the application of polluted mascaras, and also some incidents, which caused severe results, due to the development of acute Pseudomonas infections following the inadvertent abrasion of a corneal tissue by the polluted applicator brush.

An object of the invention is to provide a mascara container which avoids any possible microbiological pollution of the ciliary apparatus or the adjacent eye structures.

According to the invention there is provided a dispenser comprising, in combination, a plurality of receptacles, each containing an application stick that is inserted into the product and that bears a tip which hermetically seals the receptacle or housing, and an extraction-gripping unit provided with means for engaging the gripping unit with the tip, so as to draw the application stick out of its receptacle in order to apply the make-up.

The means for engaging the gripping unit with the tip of each application stick may include a threaded head which screws onto a mating housing contained in each tip, so as to permit the easy removal and disposal of the application stick after the make-up has been applied so that the gripping and extracting unit is available for subsequent use.

The invention will be now described in greater detail with reference to the accompanying drawings which show a preferred embodiment without being restricted to the same.

Figure 2:
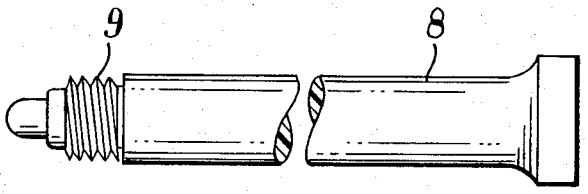

In the drawings:

FIG. 1 shows a longitudinal section of a receptacle, equipped with its application stick; and FIG. 2 shows the gripping and extracting unit.

Referring now to the drawings, the invention provides a plurality of receptacles or containers 1, joined together by means of easily breakable tabs 2, preferably made of synthetic material, or other technologically suitable material.

The receptacles or containers 1 may be also separated.

In each receptacle or container 1 there is located on application stick 3, already immersed in a quantity of the product (mascara) 4 sufficient for one application of the make-up. Each applicator stick or rod 3 is provided with a tip 5 which hermetically seals the opening of the container 1, and ends with a knurled sleeve 6 having a threaded hole 7 with inner threads. The threaded hole 7 includes an indentation 11. The extracting-gripping unit (see FIG. 2) is formed by a stem 8 connected to the upper part a threaded tailpiece 9 which corresponds to the seat 7 of FIG. 1. The threaded tailpiece 9 includes a protruberance 10.

The use of the dispenser is quite easy and intuitive: the threaded tailpiece 9 is screwed into the seat or housing 7 of the stick 3 so that the indentation 11 receives the protruberance 10, and the stick 3 is drawn out of the receptacle or container 1, and thereafter the make-up is applied. After use, the stick 3 is unscrewed by grasping the knurled sleeve 6 and is discarded. The receptacle 1, which now is empty, is also removed by tearing the joining tab 2. As it has been mentioned hereinbefore, the containers or receptacles 1 are preferably joined together by easily breakable tabs, but they may be also separated and placed in a suitable package in which there is also foreseen a housing for the gripping unit 8; moreover, the engagement between the gripping-extracting unit and the application stick may be obtained by different means, e.g., by means of a quick-joining system of known type, instead of the two threaded parts 7 and 9.

From the above disclosure it is evident that the invention, in respect of the items known, shows many advantages, among which:

Possibility of reducing or eliminating (if sterile) the bacterial agents from the formulation of the product; and Possibility of applying on the eyelashes a mascara which has in each make-up operation the same original features in respect of the sterility and asepticity conditions and in respect of chemical composition.

In summary, this invention makes the application of the product (mascara) safer by reducing, to an appreciable extent, the risks of allergic and bacterial nature of the ciliary apparatus and eye annexes, which can occur with the use of the presently known products.

The present invention has been described with reference to a preferred embodiment, but it shall be understood that many modifications and changes may be made by those skilled in the art without departing from the spirit and scope of the invention.

What is claimed is:

1. A cosmetic applicator and container assembly comprising:

a plurality of disposable cylindrical containers, a corresponding plurality of applicators, and a single extracting and gripping unit for the applicators of the assembly;

the plurality of disposable cylindrical containers being aligned in a linear array and the adjacent containers in the array being integrally joined together by connecting tabs of breakable material, each container having an internal reservoir holding cosmetic material and having a closed bottom end and an open mouth end, the same cosmetic material being contained in the reservoirs of all of the joined containers;

each of the plurality of applicators being disposed in sealing relation with the open mouth end of a container, each applicator having a first portion comprising a cosmetic applying stick extending into the internal reservoir of cosmetic material, a second portion integral with the first portion including a cylindrical section fitting closely into the open mouth end of the cylindrical container and forming a hermetic seal therefor, and a third portion integral with the second portion and of larger diameter than the second portion and formed with an external shoulder adjacent to the second portion and terminating in a surface extending substantially perpindicularly to the axis of the container, the terminal surface being formed with a hole having a threaded portion and an internal recess extending axially inwardly from the threaded portion; and the extracting-gripping unit comprising a handle and a tailpiece integral with the handle, the handle having a shoulder adapted to engage the terminal surface of the third portion of an applicator, and the tailpiece having a threaded portion adapted to be screwed into the threaded hole of the third portion of an applicator and also having an integral imporforate axial projection extending beyond the threaded portion to be received in the internal recess of the third portion of an applicator;

whereby a plurality of separate portions of the same cosmetic material are provided in a unitary container assembly, each portion being hermetically sealed until the corresponding applicator is removed so that any contamination of a portion of cosmetic material in one reservoir can not affect the portions of cosmetic material contained in the other reservoirs of the assembly, each applicator being readily removable from the container by threaded connection thereto of the extracting-gripping unit, the tailpiece of the extracting-gripping unit being easily guided into the hole of each applicator by axial projection thereon so as to facilitate connection of the threaded portion of the tailpiece of the extracting gripping unit with the threaded portion of the hole of the applicator, the axial projection also providing added rigidity to the applicator when it is joined to the extracting-gripping unit while permitting easy separation of the applicator from the extracting-gripping unit.

2. A cosmetic applicator and container assembly according to claim 1 wherein the handle of the extracting-gripping unit has an enlarged end portion with a terminal surface extending perpendicularly to the axis of the unit to permit the extracting-gripping unit together with an attached applicator to stand on the enlarged end portion and thereby avoid contamination of cosmetic material carried by the applicator stick.

* * * * *